US008110972B2

(12) United States Patent
Chen

(10) Patent No.: US 8,110,972 B2
(45) Date of Patent: Feb. 7, 2012

(54) COMPOUND HID ELECTRIC ARC TUBE

(75) Inventor: Zonglie Chen, Beijing (CN)

(73) Assignee: Yancheng Haomai Lighting Science & Technology Co., Ltd., Yancheng (CN)

( * ) Notice: Subject to any disclaimer, the term of this patent is extended or adjusted under 35 U.S.C. 154(b) by 0 days.

(21) Appl. No.: 12/910,208

(22) Filed: Oct. 22, 2010

(65) Prior Publication Data

US 2011/0031869 A1 Feb. 10, 2011

Related U.S. Application Data

(63) Continuation of application No. PCT/CN2008/001304, filed on Jul. 11, 2008.

(30) Foreign Application Priority Data

May 5, 2008 (CN) ..... 2008 1 0097227

(51) Int. Cl.
*H01J 11/00* (2006.01)
*H01J 17/16* (2006.01)
*H01J 5/00* (2006.01)

(52) U.S. Cl. ..... 313/317; 313/567; 313/633; 313/634; 313/635; 313/636

(58) Field of Classification Search ..... None
See application file for complete search history.

(56) References Cited

U.S. PATENT DOCUMENTS 7,187,128 B2 * 3/2007 Niimi ..... 313/623
7,362,053 B2 * 4/2008 Wei et al. ..... 313/636
2005/0027594 A1 2/2005 Yasnovsky et al.
2006/0242013 A1 10/2006 Agarwal et al.
2011/0059839 A1 * 3/2011 Miyazawa et al. ..... 501/152

FOREIGN PATENT DOCUMENTS

JP 10-208700 8/1998
JP 2002-157974 A 5/2002
JP 2004-55226 A 2/2004
JP 2006-99966 A 4/2006

OTHER PUBLICATIONS

International Search Report dated Jan. 8, 2009, PCT/CN2008/001304, filed Jul. 11, 2008.

* cited by examiner

*Primary Examiner* — Natalie Walford
(74) *Attorney, Agent, or Firm* — Brinks Hofer Gilson & Lione

(57) ABSTRACT

A composite High Intensity Discharge ("HID") arc tube includes a discharge tube and two outwardly extending tubes. The discharge tube is a composite two-layer shell with an outer of fused quartz glass or Vycor quartz glass, and a layer of translucent polycrystalline alumina ("PCA"). The outwardly extending tubes are made of fused quartz glass or Vycor quartz glass, and a layer of polycrystalline alumina is applied at ends of the outwardly extending tubes close to an arc chamber. After the arc tube is sintered at a high temperature, the electrode is sealed by being separated into two segments. The first segment of the outward extending tube applied with PCA is sealed by glass solders, and the second segment of quartz glass is sealed by a molybdenum foil under pressure.

17 Claims, 1 Drawing Sheet

COMPOUND HID ELECTRIC ARC TUBE

PRIORITY

This application is a Continuation of PCT/CN2008/001304, entitled "COMPOUND HID ELECTRIC ARC TUBE" and filed on Jul. 11, 2008, which claims priority to Chinese Application No. 200810097227.7, entitled "COMPOUND HID ELECTRIC ARC TUBE" and filed on May 5, 2008, each of which are hereby incorporated by reference.

FIELD OF THE APPLICATION

The present application relates to arc tubes used in the lighting equipment, including composite High Intensity Discharge ("HID") arc tubes used in HID lamps.

BACKGROUND

Quartz may be chosen as the material for HID arc tubes because quartz can withstand high pressure of about 200-300 times of the atmospheric pressure; on the other hand, arc tubes made of quartz is easy to be encapsulated or sealed. However, quartz materials also have apparent disadvantages; i.e. on one hand, the dimension of the inner chamber of the quartz arc tube has uncontrollable tolerance, since the quartz arc tube is formed by molding hot melt at a high temperature by pressing outer mold against the inner chamber while blowing highly pressurized gas into the inner chamber; on the other hand, when the quartz arc tube operates at a high temperature, the color rendering property deteriorates with reduced luminous efficacy and stability, and the lost of sodium in the lamp is severe.

Quartz arc tubes, especially low power lamps used for exhibition lighting, are replaced by polycrystalline alumina ("PCA") ceramic arc tube to significantly enhance the consistency and stability of light color. The replacement of quartz arc tube by ceramic arc tube improves the color consistency of metal halide lamp ("MH"), one reason is that the base body used to make ceramic arc tube is shaped by molding or grout molding at an ordinary temperature, so that its dimension is well controlled; and another reason is that ceramic arc tube increases the operation temperature of the tube wall. Thus, in case that the temperature of the tube wall is high, a minimal value can be observed in the curve of correlated color temperatures versus temperatures of the tube wall. Ceramic arc tube is adapted to operate in a region around the corresponding color temperature minimal value (by contrast, for quartz arc tube, such minimal value area is above the appropriate endurable operation temperature of quartz glass), especially when the filling agent is halides of sodium and rare earth element, a higher operation temperature enables the lamp to have a better color rendering property (Ra>80) and higher luminous efficacy (>90 $lm \cdot W^{-1}$). Another benefit of the structure of polycrystalline alumina is in its lifetime, the loss of sodium within the lamp is greatly reduced, ensuring that the color rendering property is more stable than conventional metal halide lamp using quartz arc tube.

Chinese Patent No. 98115658.4, the entire disclosure of which is incorporated by reference herein, discloses a ceramic shell component of high intensity discharge lamp, which has a shell structure of PCA shell, and specially designed multi-layer structure of axially delaminated aluminum oxide-metal ceramic. The terminal therein provided with multiple elements has its last element directly sintered to the corresponding feed-through wire without any sealing material, while keeping a certain thermal expansion coefficient.

However, in fact, due to high operation temperature and intense corrosion due to fused metal halide and steam of the lamp, such sealing methods cannot provide long-term reliable sealing and a longer lifetime.

U.S. Pat. No. 6,313,582, the entire disclosure of which is incorporated by reference herein, discloses a ceramic lamp, in which the discharge tube is made of translucent ceramic, and the tube sealing part is terminally encapsulated by means of $Dy_2O_3$—$Al_2O_3$—$SiO_2$ based sealing material. It may be difficult to encapsulate the electrode of such arc tube made of ceramic due to poor pressure resistance of PCA itself (since it may only withstand about 3-5 times of the atmospheric pressure). In the actual state of air exhaust, it may not be easy to fill metal halide balls, inject mercury, inflate various inert gases into the arc, and maintain gas sealing between the outer lead of electrode and ceramic material by filling glass solders. The last step of manufacturing arc tube may fail, meaning that all the previous steps were wasted, and the yield rate of the arc tube is affected, and the costs cannot be lowered. Moreover, the technique in the art may only enable an arc tube with power of 150 W or lower, as an arc tube with high power of 250 W or up to several KW is not commercially applicable.

SUMMARY

The application proposes a new arc tube which combines the advantages of quartz material and translucent polycrystalline alumina. A composite HID arc tube is provided with a layer of translucent polycrystalline alumina that is applied on an arc tube manufactured by blow-molding quartz glass or Vycor quartz glass. The arc tube is heated at high temperature and molded, so as to form a composite HID arc tube made of fused quartz glass and translucent polycrystalline alumina, or Vycor quartz glass and translucent polycrystalline alumina Such composite HID arc tube maintains the advantages of quartz glass including ease of encapsulation or sealing, and endurance to high working pressures; while the translucent polycrystalline alumina is applied on the inner casing with grout-molding, a strict control of the dimension of the inner chamber of the arc tube is resulted, thus the working temperature of the inner wall of the arc tube is increased and sodium penetration is prevented effectively. By using such a composite HID arc tube, the inflation pressure in the lamp may be increased by 20%-50% of that of ceramic metal halide lamp made of ordinary polycrystalline alumina Therefore, the luminous efficacy may be enhanced by about 25%, and particularly, such a composite HID arc tube can be employed to manufacture the arc tube of light source like Ultra High Pressure Mercury Discharge lamp (UHP) to effectively overcome the problem that the pressure resistance of quartz glass arc tube of UHP being reduced due to re-crystallization and devitrification of the inner wall caused by too high temperature of the inner wall, and thus results in an early failure.

A composite HID arc tube comprises a discharge tube and two outwardly extending tubes, where the discharge tube is a composite two-layer shell formed of an outer shell manufactured by blow-molding fused quartz glass or Vycor quartz glass, and applying a layer of translucent polycrystalline alumina on the outer shell. The outwardly extending tubes are made of fused quartz glass or Vycor quartz glass, wherein a layer of polycrystalline alumina is applied at the ends of said outwardly extending tubes close to arc chamber. The arc chamber of the discharge tube may be in the shape of olive or ellipse. An inner wall of the arc chamber as well as inner walls of segments of the outwardly extending tubes close to the arc chamber may be 3~8 mm long and may be uniformly applied with a layer of translucent polycrystalline alumina of a thickness of 0.2~0.5 mm. Two different sealing methods may be used at each of the outwardly extending tubes.

According to another aspect of the composite HID arc tube, a glass solder made of a mixture of $Al_2O_3$, $Dy_2O_3$, $SiO_2$ is used to seal a region of said outwardly extending tube applied with the layer of polycrystalline alumina, a region of said outwardly extending tube made of quartz glass is heated by coal-oxygen fire and then sealed under pressure.

In the composite HID arc tube, the layer of polycrystalline alumina may be applied by the following steps: an inserted body made of heat-resistant silica gel is inserted into the arc chamber of the discharge tube and the outwardly extending tube, air under a certain pressure is injected such that the inserted body made of silica gel turns into a sophisticated inner lining film; and ceramic powder slurry is injected into the gap between the inner lining film and the outer shell, wherein the ceramic powder slurry is obtained by uniformly mixing highly-pure aluminum oxide powder, a small amount of adhesive, grain generation inhibitor, and plasticizer; after grouting and molding, cures at room temperature and then performs mould unloading; then, heats under pressure at low temperature of 500° C.~600° C. and pre-heats under medium temperature of 1000° C.; and then a fine aluminum oxide outer mold and a sleeve of the inner lining film are applied so as to prevent quartz glass from deforming under high temperature; after being calcinated in vacuum for 3-4 hours under 1800° C., the article is rapidly removed from the high temperature furnace and then cooled down by strong wind.

As compared with the poor high-temperature resistance, ease of loss of sodium of quartz glass, as well as poor pressure resistance and thus poor sealing capability of polycrystalline alumina, the composite HID arc tube maintains the advantages of quartz glass of ease of molding, ease of sealing, good pressure resistance and high operating pressure, and also has the advantages of polycrystalline alumina (PCA) arc chamber of dimension regularization, high temperature resistance and good sodium penetration resistance. Thus, the composite HID arc tube as claimed enhances the working pressure and working temperature, prevents sodium penetration and deformation resulted from the liquid-state silicon film on the surface of the electrode, improves the stability of color rendering and luminous efficacy of HID, especially MH lamp, and extends the lifetime of the lamp.

The objects, features and advantages of the invention will be described in detail with respect to the embodiments and in connection to the figures.

BRIEF DESCRIPTION OF THE DRAWINGS

The system and method may be better understood with reference to the following drawings and description. Non-limiting and non-exhaustive embodiments are described with reference to the following drawings. The components in the drawings are not necessarily to scale, emphasis instead being placed upon illustrating the principles of the invention. In the drawings, like referenced numerals designate corresponding parts throughout the different views. The application is described in detail with respect to the figures below.

DETAILED DESCRIPTION

Figure 1:
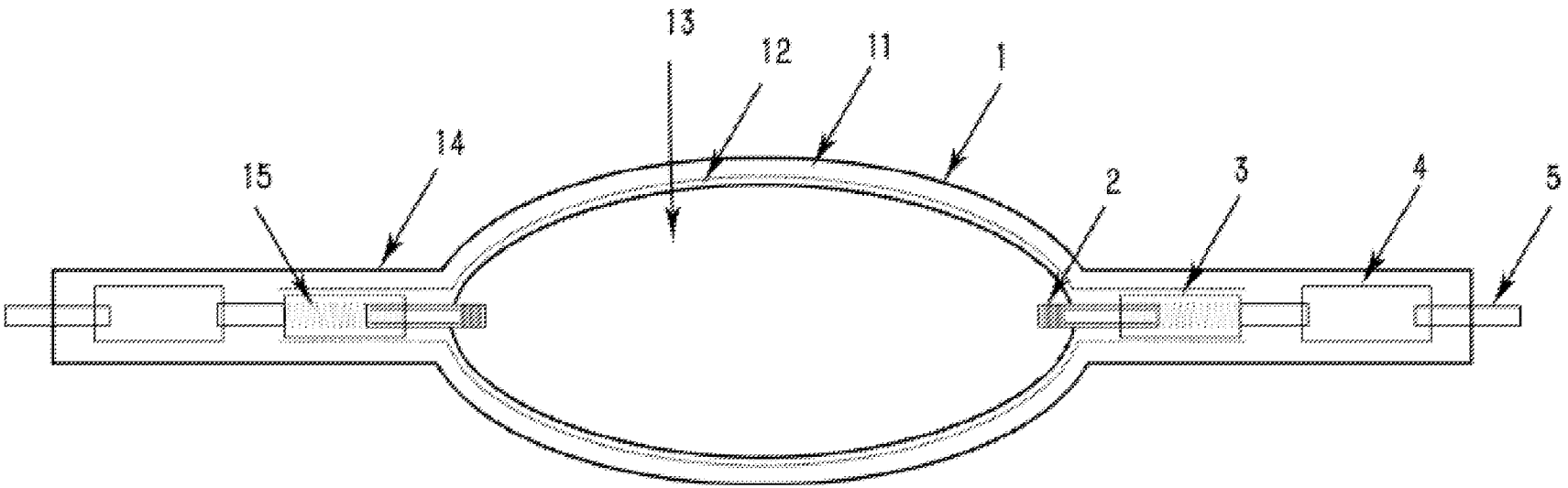
FIG. 1 is a schematic diagram of a composite HID arc tube.

As illustrated in FIG. 1, the composite HID arc tube has a discharge tube 1, electrodes 2, molybdenum leads 3, molybdenum foils 4, and molybdenum outer leads 5, wherein the electrodes 2 are arranged within an arc chamber 13 of the discharge tube 1, and the molybdenum leads 3, molybdenum foils 4 and molybdenum outer leads 5 are sequentially connected to the electrodes 2, which are respectively disposed in two outwardly extending tubes 14 at the two ends of the discharge tube 1. The outer shell of the discharge tube 1 is made of blow-molded fused quartz glass or Vycor quartz glass 11, and applying a layer of translucent polycrystalline alumina 12 on the outer shell to form a composite two-layer shell. Each of both sides of the arc chamber 13 of the discharge tube 1 are provided with a long and thin outwardly extending tubes 14, and a translucent polycrystalline alumina layer 12 is also applied on one end of the outwardly extending tubes 14 close to the arc chamber 13. The electrode 2, the molybdenum lead 3, the molybdenum foil 4 and the molybdenum outer lead 5 are sequentially arranged in a direction away from the arc chamber 13. The region of the outwardly extending tube 14 corresponding to the molybdenum lead 3 is a region applied with polycrystalline alumina 12, and the glass solder 15 mainly made of mixture of $Al_2O_3$, $Dy_2O_3$, $SiO_2$ is used for sealing. The region of the outwardly extending tube 14 corresponding to the molybdenum foil 4 is a region of a single-layer glass tube which is made of quartz glass 11 heated by coal-oxygen fire and then sealed under pressure. The discharge tube 1 can be filled with different kinds of metal halides, mercury or its alternatives, high purity argon, mixture gas of argon and neon, or xenon depending on its lamp type.

In the composite HID arc tube of the application, the arc chamber 13 of the discharge tube 1 is in a shape of olive or ellipse, and the inner wall of the arc chamber 13 as well as the inner wall of the 3~8 mm long segment of the outwardly extending tube 14 close to the arc chamber 13 are uniformly applied with a layer of translucent polycrystalline alumina 12, which has a thickness of 0.2~0.5 mm.

In the composite HID arc tube of the application, the electrode 2 is sealed such that a first segment and a second segment are separately sealed segment by segment. The inner wall of the arc chamber 13 of the discharge tube 1 as well as the inner wall of the 3~8 mm long segment of the outwardly extending tube 14 close to the arc chamber 13 may be uniformly applied with a layer of translucent polycrystalline alumina 12. During the application of the layer of translucent polycrystalline alumina 12, an inserted body made of heat-resistant silica gel is inserted into the arc chamber 13 of the discharge tube and the outwardly extending tube 14, air under a certain pressure is then injected such that the inserted body made of silica gel turns into an sophisticated inner lining film; and then ceramic powder slurry is injected into the gap between the inner lining film and the fused quartz glass or Vycor quartz glass shell 11 of the discharge tube 1, wherein the ceramic powder slurry is obtained by uniformly mixing high pure aluminum oxide powder, a small amount of adhesive, grain generation inhibitor, and plasticizer.

The inner wall of the arc chamber 13 as well as the inner wall of the 3~8 mm long segment of the outwardly extending tube 14 close to the arc chamber 13 may be uniformly applied with a layer of translucent polycrystalline alumina 12. After grouting and molding, curing at room temperature and then mould unloading; then, heating under pressure at low temperature of 500° C.~600° C. and pre-heating under medium temperature of 1000° C.; and then a fine aluminum oxide outer mold and a sleeve for the inner lining film are applied so as to prevent quartz glass 11 from deforming under high temperature. After being calcinated in vacuum for 3-4 hours under 1800° C., the article is rapidly removed from the high temperature furnace and then cooled down by strong wind, so that the quartz glass shell 11 is prevented from devitrifying.

The electrode 2 may be sealed in a way such that a first segment and a second segment are separately sealed segment by segment. A segment of both of the outwardly extending tube 14 is designated as the first segment which is about 3~8 mm long and close to one end of the arc chamber 13; and another segment of both of the outwardly extending tube 14 is designated as the second segment which is about 10~20 mm long and extends outwardly from the first segment. Similar to the inner wall of the arc chamber 13, the inner wall of the first segment of the outwardly extending tube 14 is also applied with a layer of translucent polycrystalline alumina 12; and sealed by glass solder 15 mainly made of mixture of $Al_2O_3$, $Dy_2O_3$, $SiO_2$. The second segment is quartz glass or improved quartz glass 11, such as Vycor quartz glass or molybdenum resistance glass; and the molybdenum foil 4 is used to seal in an uncomplimentary manner, or directly use a molybdenum bar to seal in a complimentary manner, so as to enhance the airtightness of the lamp under super high pressure such as 100~200 atm.

In the example as illustrated in FIG. 1, the discharge tube 1 uses an elliptical arc tube shell 11, which is manufactured by blow-molding high pure quartz glass with a hydroxy content of no more than 10 ppm. The maximal diameter Φ of the elliptical arc tube shell 11 is 18.5 mm, the average thickness of the wall of the elliptical arc tube shell 11 is 1.8 mm, and the thickness of the thinnest part of the wall of the elliptical arc tube shell 11 is no less than 1.5 mm. The layer of translucent polycrystalline alumina (PCA) 12 is applied and sintered within the elliptical arc tube shell 11. The average thickness of the layer of translucent polycrystalline alumina 12 is 0.2 mm, the thickness of thinnest part of the layer of translucent polycrystalline alumina 12 is no less than 0.15 mm, and the thickness of thickest part the layer of translucent polycrystalline alumina 12 is no more than 0.25 mm. The electrode 2 is made of materials of thorium and tungsten and thus has good emissive property. ScI3-CeI3-InI3-TlI—NaI is selected as the metal halide filler of the lamp, so that the load Ws of the tube wall is about 20 W/cm$^2$, and the nominal power of the lamp is 150 W.

In case that the lamp is used with an electronic ballast which employs high-frequency square wave current and voltage and outputs a constant power, the test results are as follows: the initial luminous efficacy is no less than 110 lm/W, the average luminous efficacy is 95 lm/W, the color rendering index Ra≧85, the color temperature is 4200K, and the lifetime is 20,000 hours; the color consistency in the lifetime of the lamp is greatly improved when compared with quartz scandium sodium lamp.

According to one embodiment, molybdenum lead wire and molybdenum foil are used for electrically connecting the electrode, however, the application is not limited to molybdenum, and any other suitable metal or alloy can be used alternatively.

The arc tube may be used to manufacture ceramic metal halide lamp, conventionally in a double-end manner or in a single-end manner. In the double-end manner, both sides of the outer shell of the lamp are provided with conducting wires connecting both sides of the arc tube, and the shape of the outer shell of the lamp can be cylindrical or conical. In the single-end manner, only one side of the outer shell of the lamp is provided with conducting wire, through which the leads of both sides of the arc tube are connected to the outside, and the shape of the outer shell of the lamp can be spherical or elliptical.

The above-mentioned patents or publications as a whole are all incorporated herein as references. The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

The invention claimed is:

1. A composite HID arc tube comprising:

a discharge tube comprising a composite two-layer shell formed of an outer shell manufactured by blow-molding fused quartz glass or Vycor quartz glass, wherein a layer of translucent polycrystalline alumina is applied on the outer shell; and two outwardly extending tubes comprising fused quartz glass or Vycor quartz glass, wherein a layer of polycrystalline alumina is applied at both ends of said outwardly extending tubes close to an arc chamber.

2. The composite HID arc tube as in claim 1, wherein the inner wall of the arc chamber and the inner wall of segments of the outwardly extending tubes close to the arc chamber are 3~8 millimeters long and are uniformly applied with a layer of translucent polycrystalline alumina of thickness of 0.2~0.5 millimeters.

3. The composite HID arc tube as in claim 2, wherein the arc chamber of the discharge tube is in the shape of olive or ellipse.

4. The composite HID arc tube as in claim 3, wherein two different sealing methods are used at each of the outwardly extending tubes.

5. The composite HID arc tube as in claim 2, wherein two different sealing methods are used at each of the outwardly extending tubes.

6. The composite HID arc tube as in claim 1, wherein the arc chamber of the discharge tube is in the shape of olive or ellipse.

7. The composite HID arc tube as in claim 6, wherein two different sealing methods are used at each of the outwardly extending tubes.

8. The composite HID arc tube as in claim 1, wherein two different sealing methods are used at each of the outwardly extending tubes.

9. A composite high intensity discharge ("HID") arc tube comprising:

a discharge tube comprising a composite two-layer shell formed of an outer shell manufactured by blow-molding fused quartz glass, wherein a layer of translucent polycrystalline alumina is applied on the outer shell;

an arc chamber formed within the shell of the discharge tube; and two outwardly extending tubes comprising fused quartz glass, wherein a layer of polycrystalline alumina is applied at both ends of said outwardly extending tubes close to the arc chamber.

10. The composite HID arc tube as in claim 9, wherein the inner wall of the arc chamber and the inner wall of segments of the outwardly extending tubes close to the arc chamber are 3~8 millimeters long and are uniformly applied with a layer of translucent polycrystalline alumina of thickness of 0.2~0.5 millimeters.

11. The composite HID arc tube as in claim 10, wherein the arc chamber of the discharge tube is in the shape of olive or ellipse.

12. The composite HID arc tube as in claim 11, wherein two different sealing methods are used at each of the outwardly extending tubes.

13. The composite HID arc tube as in claim 10, wherein two different sealing methods are used at each of the outwardly extending tubes.

14. The composite HID arc tube as in claim 9, wherein the arc chamber of the discharge tube is in the shape of olive or ellipse.

15. The composite HID arc tube as in claim 14, wherein two different sealing methods are used at each of the outwardly extending tubes.

16. The composite HID arc tube as in claim 9, wherein two different sealing methods are used at each of the outwardly extending tubes.

17. The composite HID arc tube as in claim 9, wherein the fused quartz glass comprises Vycor quartz glass.

* * * * *